US005823291A

United States Patent [19]

Goldbach

[11] Patent Number: 5,823,291

[45] Date of Patent: Oct. 20, 1998

[54] SELF-CONTAINED DEVICE FOR CLEANING AND COATING HOLD SURFACES IN A BULK CARRIER

[75] Inventor: Richard A. Goldbach, Norfolk, Va.

[73] Assignee: Metro Machine Corporation, Norfolk, Va.

[21] Appl. No.: 802,676

[22] Filed: Feb. 19, 1997

[51] Int. Cl.[6] ..... B66C 23/04

[52] U.S. Cl. ..... 182/141; 182/65.2; 182/129

[58] Field of Search ..... 182/141, 62.5, 182/128, 129

[56] References Cited

U.S. PATENT DOCUMENTS

| | | | |
|---|---|---|---|
| 3,031,027 | 4/1962 | Mitchell | 182/62.5 |
| 3,093,210 | 6/1963 | Picard | 182/141 |
| 3,306,396 | 2/1967 | Goss | 182/128 |
| 3,516,512 | 6/1970 | Kupko | 182/141 |
| 3,517,771 | 6/1970 | Muhringer | 182/141 |
| 5,542,495 | 8/1996 | Aulakh | 182/141 |

FOREIGN PATENT DOCUMENTS

| | | | |
|---|---|---|---|
| 2384437 | 11/1978 | France | 182/141 |
| 2458503 | 2/1981 | France | 182/62.5 |

*Primary Examiner*—Alvin C. Chin-Shue

*Attorney, Agent, or Firm*—IP Group of Pillsbury Madison & Sutro LLP

[57] ABSTRACT

The self-contained device for cleaning and coating hold surfaces in a bulk carrier includes four major components, namely a horizontally mobile vertical tower (e.g., with walking beams for permitting the device to move into the four corners of the hold into which it has been lowered), a vertical trolley for permitting the workers to reach with their equipment all elevations within the hold, a horizontal trolley for permitting the workers to achieve optimum proximity to a wall surface, and cleaning and coating support equipment and systems. By preference, the device can be lifted into and out of the cargo hold altogether, or in a maximum of two sections, including a base section (which includes the base of the vertical tower, walking beams, all required systems for cleaning and coating, worker air supply and electrical power, as well as lower parts of distribution systems, with connectors), and an upper section (which includes a variable height upper vertical tower, vertical trolley, variable extension horizontal trolley, vertical trolley hoist mechanism, horizontal trolley extension mechanism, and upper parts of distribution systems, with connectors). The upper section is stackable on the base. The walkway on the horizontal trolley extends on all four sides, in order to permit working from at least two sides simultaneously for each of four positions of the base on the bottom of the hold.

7 Claims, 7 Drawing Sheets

SELF-CONTAINED DEVICE FOR CLEANING AND COATING HOLD SURFACES IN A BULK CARRIER

BACKGROUND OF THE INVENTION

A typical bulk carrier is a shipping vessel having a hull, within at least a major portion of at least the midbody of which, the internal volume bounded by the sidewalls and bottom of the hull, is partitioned into a plurality of cargo holds (sometimes alternatively called tanks). Depending on the vessel width and length, the cargo holds are arranged in one or more side-by-side columns extending lengthwise of the vessel and separated by longitudinal bulkheads, and a plurality of longitudinally adjacent rows and separated by transverse bulkheads. The upper ends of the longitudinal bulkheads and hull sidewalls, with associated structure, provide respective fore-aft walkways of the deck of the vessel, and the upper ends of the transverse bulkheads provide port-starboard walkways of the deck. The bottoms of the individual holds are formed by respective portions of the upper surfaces of the inner side of the bottom of the hull. Portions of the sidewalls of individual holds, whether formed by vessel hull sidewall, sides of longitudinal bulkheads or sides of transverse bulkheads are generally vertical, but may have sloped, beveled or curved regions. The holds typically are open at the top throughout an area which is substantially large as their maximum horizontal cross-sectional area. These openings, generally referred to as hatches, are normally closed during transportation, storage and waiting periods, by openable hatch covers. Hatch covers may be designed to be physically lifted out of position as a unit, or to be folded, tented or rolled out of position.

A typical bulk cargo vessel is used for transporting a flowable or pumpable commodity, without use of any containers or packaging material but for the confines of the hold. However, sometimes boxes, bags, drums, containers and other packaging confines the commodity being shipped in a hold, in quanta smaller than the bulk of a single hold.

A bulk cargo vessel may be single-hulled throughout, double-hulled throughout, or partially double-hulled (for instance, double bottomed) and the remainder single-hulled.

The walls of each side, the bottom and the top of a bulk cargo hold typically are made of steel plate, welded at edges and intersections.

The internal wall surfaces of a bulk cargo hold are subjected to at least some of the same stressful environmental conditions as is the outer surface of the vessel hull. In fact, due to the reactive or corrosive nature of some bulk materials transported, e.g., rock salt, and the confined space, the environmental stress on the wall surfaces of a bulk cargo hold can cause surface deterioration at a greater rate than is experienced by the exterior of the vessel hull. Therefore, for lengthening the economic life of the cargo vessel and keeping it in good repair, the internal surfaces of each bulk cargo hold are best cleaned and coated when the vessel is new, and then periodically recleaned and recoated.

It is possible, when fabricating a new bulk cargo vessel, to clean and coat at least some of the plates that will form respective parts of the hull and holds prior to welding the sheets together to provide the respective walls, and then, after welding, to more simply clean or reclean and coat or recoat the areas at and bordering the welded seams. There is a particularly attractive style of work if the coating being provided is a reactive (e.g., "epoxy") coating whether applied by dipping, rolling or spraying.

However, in many instances, the hold wall surfaces, like the vessel hull exterior surfaces, of a new vessel being built, are cleaned and coated entirely after cutting, welding, bolting and installation of at least some fittings have been conducted.

In both the latter instance of such new manufacture, and in ship repair and refurbishment, it has heretofore been a common practice to clean and coat the hold walls (a term which is used herein to include sidewalls whether provided by hull surfaces, longitudinal bulkhead surfaces transverse bulkhead surfaces, the top sides of hull bottom walls and the undersides of hatch covers), using portable staging temporarily erected in the hold, possibly supplemented or replaced by use of a mobile "cherry picker" type of operator-lift temporarily lowered into the hold.

Surface cleaning typically involves forcibly impacting particles of an abrasive material ("grit") against the surface which is to be cleaned. In some instances, the particles are simply sprayed in a blast of compressed air, issuing through a hose and out of a nozzle pointed at the work surface by a human operator who is wearing protective clothing and breathing gear. In other instances, the similarly attired worker uses a pneumatically or gravity-fed centrifugal impeller the outlet opening of which they direct against the work surface.

As the abrasive grit impacts against the surface to be cleaned, it abrades away whatever is most vulnerable to its attack, principally scale, rust, caked-on remainder of former cargoes, and what remains from prior coatings applied, as affected by the environment since application. It is an operator's responsibility when abrasive blasting, to continue working on a local region of the surface, until substantially all that is 'bad' is gone, but without substantially eating into what is 'good', and then moving on, to the cleaning of an adjacent or next region of the surface.

The spent grit, therefore, contains not only the material impelled against the surface, as affected by the impact, but also the removal material, all mixed together. In some instances, the work head includes a spent-grit recovery mechanism, such as an underlying catch basin or funnel and suction line, so that the abrasive blasting is conducted as a clean-up-as-you-go operation. In other instances, the spent grit simply falls to the floor, i.e., the upper surface of the bottom wall, and onto the predominately upwardly facing surfaces of staging and equipment, and is swept up, vacuumed up or otherwise collected by workers working in support of the blasting operators.

In some instances, the grit is made of sharp-grained particles of refractory material such as Carborundum or agate; in other instances, it is made of hard, sharp fragments of ferromagnetic material, including bits or balls of steel. In such instances, collecting the ferromagnetic component of the spent grit separately from fragments of coating and other debris is possible, using magnetic or electromagnetic collectors or separators.

Spent grit can be fractionated and the various fractions subjected to differing benefaction, disposal and re-use procedures.

Coatings following cleanings are typically applied by spraying. Generally, these are made of what a non-technical person, and often a person in the trade speaking colloquially would call 'paint'.

The current trend in coatings, is to ones which include as the vehicle or medium which enables and facilitates application, spreading and continuity of layering, yet upon completion of its contribution to the process, generates a minimum of volatile organic compounds available to escape into the air and, therefore, needing to be contained, abated, combusted or otherwise dealt with.

The staging conventionally used in holds for worker support while conducting cleaning and painting operations, typically is conventional construction scaffolding, which includes many modular sections of framework, and planking. In one sense it is convenient to use such staging, because one set of component parts can be assembled in many different combinations, in order to enable work on holds having various lengths, widths, heights and physical intrusions. However, set-up and tear-down are time consuming, and worker error in securing planks, climbing on scaffolding and dropping parts unfortunately results in accidents and injury. And, each shift of work and each set-up and tear-down involves clambering on the scaffolding, often while carrying heavy equipment. Blasting and coating equipment needs to be assembled and taken apart, including pneumatic and liquid-delivery hoses, and electric cabling.

SUMMARY OF THE INVENTION

The present invention seeks to preserve the functionality of the heretofore conventional method and apparatus for cleaning and coating the internal surfaces of bulk cargo vessel holds, while overcoming the shortcomings and drawbacks incident to:

- the time, cost and worker safety risk of fully staging cargo holds, including installation and removal of staging uprights and boards;
- the time, cost and worker safety risk of coating personnel having to climb staging while carrying coating equipment to access surfaces to be coated;
- the time and cost of installing and hooking-up cleaning and coating equipment, including hoses and electrical cables; and
- the cost of acquiring, handling and disposing of mineral abrasive, in some instances,
- while providing a method and system which is affordable to manufacture and use, and is easily adapted to use in holds having a wide range of sizes and shapes.

The self-contained device for cleaning and coating hold surfaces in a bulk carrier includes four major components, namely a horizontally mobile vertical tower (e.g., with walking beams for permitting the device to move into the four corners of the hold into which it has been lowered), a vertical trolley for permitting the workers to reach with their equipment all elevations within the hold, a horizontal trolley for permitting the workers to achieve optimum proximity to a wall surface, and cleaning and coating support equipment and systems. By preference, the device can be lifted into and out of the cargo hold altogether, or in a maximum of two sections, including a base section (which includes the base of the vertical tower, walking beams, all required systems for cleaning and coating, worker air supply and electrical power, as well as lower parts of distribution systems, with connectors), and an upper section (which includes a variable height upper vertical tower, vertical trolley, variable extension horizontal trolley, vertical trolley hoist mechanism, horizontal trolley extension mechanism, and upper parts of distribution systems, with connectors). The upper section is stackable on the base. The walkway on the horizontal trolley extends on all four sides, in order to permit working from at least two sides simultaneously for each of four positions of the base on the bottom of the hold.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
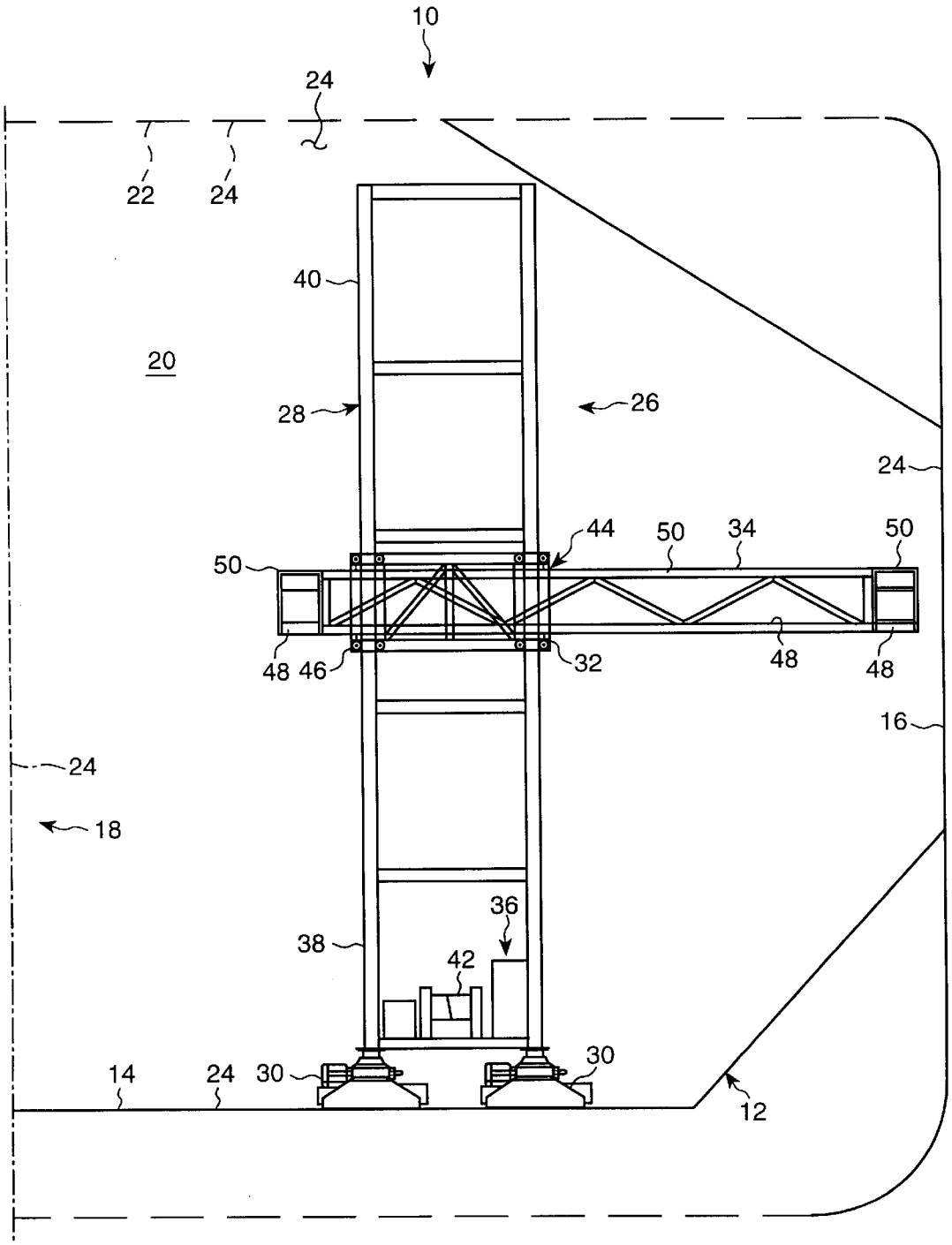
FIG. 1 is a front elevational view of the self-contained device for cleaning and painting hold surfaces in a bulk carrier, the device being shown supported in a hold with the vertical trolley about halfway elevated, and the horizontal trolley maximally extended towards the sidewall of the hull.

In the drawings, a bulk carrier vessel 10 is schematically and fragmentarily shown including walls defining a hold 12. In the instance depicted, the deck 14 (bottom wall) of the hold is provided by the bottom of the hull (which would be the inner hull, in the case of a double-bottomed hull, one side wall 16 is provided by the vessel hull, an opposite side wall 18 is provided by the vessel hull on the opposite side, or by a longitudinal bulkhead, another set of two mutually opposite sidewalls 20 is provided by two successive transverse bulkheads, and the top wall 22 is provided by the underside of a removable displaceable hatch cover or set of hatch covers for the hold. It is these walls 14–22 which provide the internal surfaces 24 of the hold 12, and which are to be cleaned and coated.

The self-contained device 26 for cleaning and coating the hull surfaces 24 is sufficiently small in horizontal cross-sectional outline that it can be lowered through the smallest hatch into and raised out of a hold of the least accommodating vessel on which it is expected to be used, yet sufficiently large in horizontal cross-sectional outline, and extensibility, that preferably, workers working from it, can reach all of the internal sidewall surfaces of the hold with no more than four moves of the device (i.e., into the four corners of the hold). In other words, its width (including extensiblity) preferably is somewhat greater than half the port-starboard dimension of the widest hold in which it will be used, and its depth (including extensibility) preferably is somewhat greater than half the longitudinal dimension of the longest hold (in the bow-to- stern direction of the vessel) in which it will be used. The height (including exchangeability of tower sections) preferably is sufficiently great to permit workers to reach the upper extents of the side walls, to clean and coat the underside of the hatch cover or hatch covers, if desired, and yet sufficiently short to permit the hatch cover (s) to be closed as cleaning and coating proceeds, in order to confine the airspace within which cleaning and coating operations are being conducted, thereby facilitating air quality management.

The device 25 is shown including four major components, namely, a vertical tower 28 having walking beams or powered trucks 30 at its base, a vertical trolley 32 which is supported on the vertical tower and subject to being raised and lowered and stationed at any desired height on the vertical tower, a horizontal trolley 34 which is supported on the vertical trolley and subject to being centered and bidirectionally shifted (typically maximally to starboard and maximally to port, although the entire device, if lowered into the hold at ninety degrees about a vertical axis to the orientation depicted, would enable shifting of the horizontal trolley, instead, maximally forwards and maximally aft), and cleaning, coating, worker breathing air, and electrical power supply and support systems 36.

The vertical tower 28 preferably is a four-sided structure fabricated of structural steel members bolted, welded or otherwise connected, possibly in two or more modules which are stackably connected (in order to provide for working in holds of varying height).

The vertical tower preferably is rectangular in plan and elevation, for example, 13–19 meters high, 8–12meters wide and 3 meters deep (in the fore to aft direction of the ship); in feet, these preferred dimensions are 40–60 feet tall, 25–35 feet wide and 10feet deep.

The vertical tower is supported at its base, i.e., the tower feet are provided by, structures which permit the tower (and, therefore, the entire device 26) to be horizontally shifted, at least in two mutually orthogonal directions (widthwise and lengthwise of the ship). In the preferred embodiment, these structures are conventional walking beams 30.

Also mounted to the vertical tower 28 at or near its base (i.e., on the lower section, if the tower is provided as stackable modules) is a full complement of supply and support systems 36, typically including an electrical distribution system, an abrasive grit supply storage and recycling system, abrasive blast and coating supply pots, a paint-mixing station, an air compressor, and distributing piping for compressed air, breathing air, abrasive grit, and paint. The electrical power supply cabling and distribution piping extend from the supply and support systems 36, to the vicinity of where on the device 26 the service is needed. In instance where the tower is constructed of modular sections, the supply cabling and distribution piping preferably include connectors that are easily made-up and taken apart at the interfaces of the modules. And the modules are made to have easily vertically made-up, easily vertically separated mechanical connectors for respective tower framing elements (e.g., complementary tapering pins and is flaring sockets), so that stacking, de-stacking, and lifting and lowering by crane is easy to accomplish. Locking together of respective tower framing elements of stacked modules can be provided, for providing added assurance against partial separation and tilting of an upper module when the vertical trolley is relatively highly elevated, the horizontal trolley is relatively extremely extended, and heavy workers and equipment are supported on the horizontal trolley relatively far from the vertical tower.

If the vertical tower 28 is provided as stacked modules, it is currently preferred that the device 26 as a whole be provided as two sections, namely a lower section 38 including a base module of the vertical tower 28, including the walking beams 30, the supply and support systems 36, and lower portions of the electrical cables and pipes, and an upper section 40 including an upper module (or an intermediate and an upper module) of the vertical tower 28, the vertical trolley 32, a hoist mechanism 42 for the vertical trolley 32, the horizontal trolley 34, an extension-retraction mechanism 36 for the horizontal trolley, and upper portions of the electrical cables and pipes.

By preference, the electrical distribution cabling and grit, air and coating piping extends from the base, up through the inside of the vertical tower 28 to its top, with take-offs (i.e., connectors for easily and disconnectably making-up and breaking-down connections) at periodic intervals, such as each 2.5 meters (in feet, each 8 feet).

By preference, two ladders extend the full height of the vertical tower, provided on the fore and aft sides of the tower framework (which is only rudimentarily shown in the drawings), complete with a safety cage around the envelope of movement of a climbing user.

In any event, the vertical tower is constructed, assembled and supported to be stable and free-standing even when the horizontal trolley is in an extreme position and fully loaded.

The vertical trolley 32 likewise preferably is a rectangular parallelepipedal framework fabricated of high strength steel members bolted and/or welded or otherwise connected together, having roller elements arranged to rollingly engage respective vertical elements of the vertical tower 28. The vertical trolley can be lowered onto lifted off of the upper end of the vertical tower, should be need arise. The hoist mechanism 42 may be located with the supply and support systems 36 on the base of the lower section 38, or fit over and be supported on the upper end of the vertical tower 28.

The rollers 32 of the vertical trolley include internal rollers, as well as external rollers, in upper and lower sets, at all four corners of the tower, in order to accommodate the port-starboard and forward-aft forces which are experienced as equipment and personnel move around on the device, and the walking beams or powered trucks 30, hoist 42 and hoist extension-retraction system 44 are operated.

The choice of which of the subsystems of the device 26 to operate using compressed air, possibly hydraulic power, or electrical power can be varied depending on local preferences, requirements and availabilities. For instance, the motor for the winch for the cables which support the vertical trolley from the hoist mechanism could be an electrical motor, an air-operated motor or a hydraulic motor.

Figure 2:
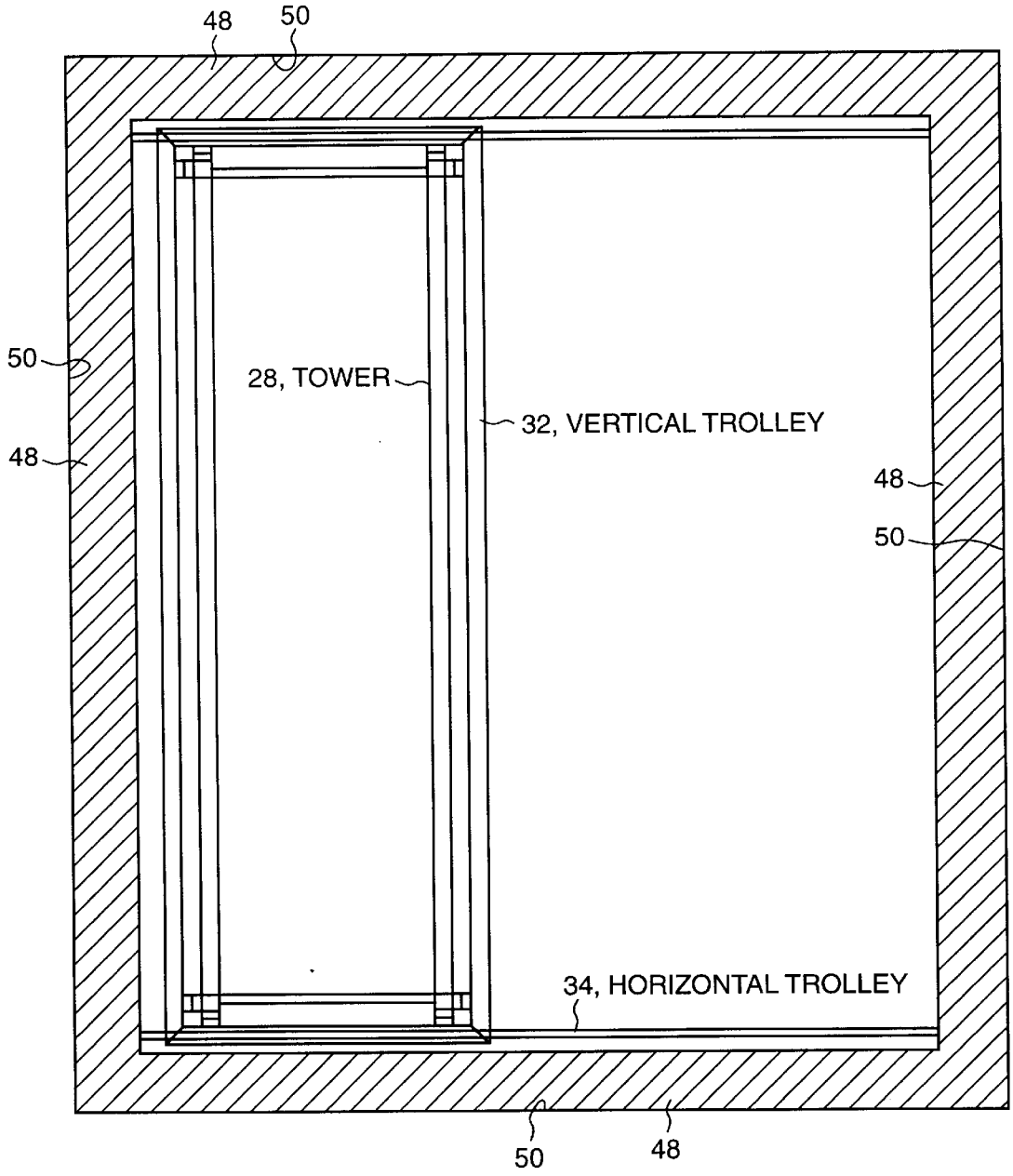
FIG. 2 is a schematic top plan view of the structures depicted in FIG. 1.
Figure 3:
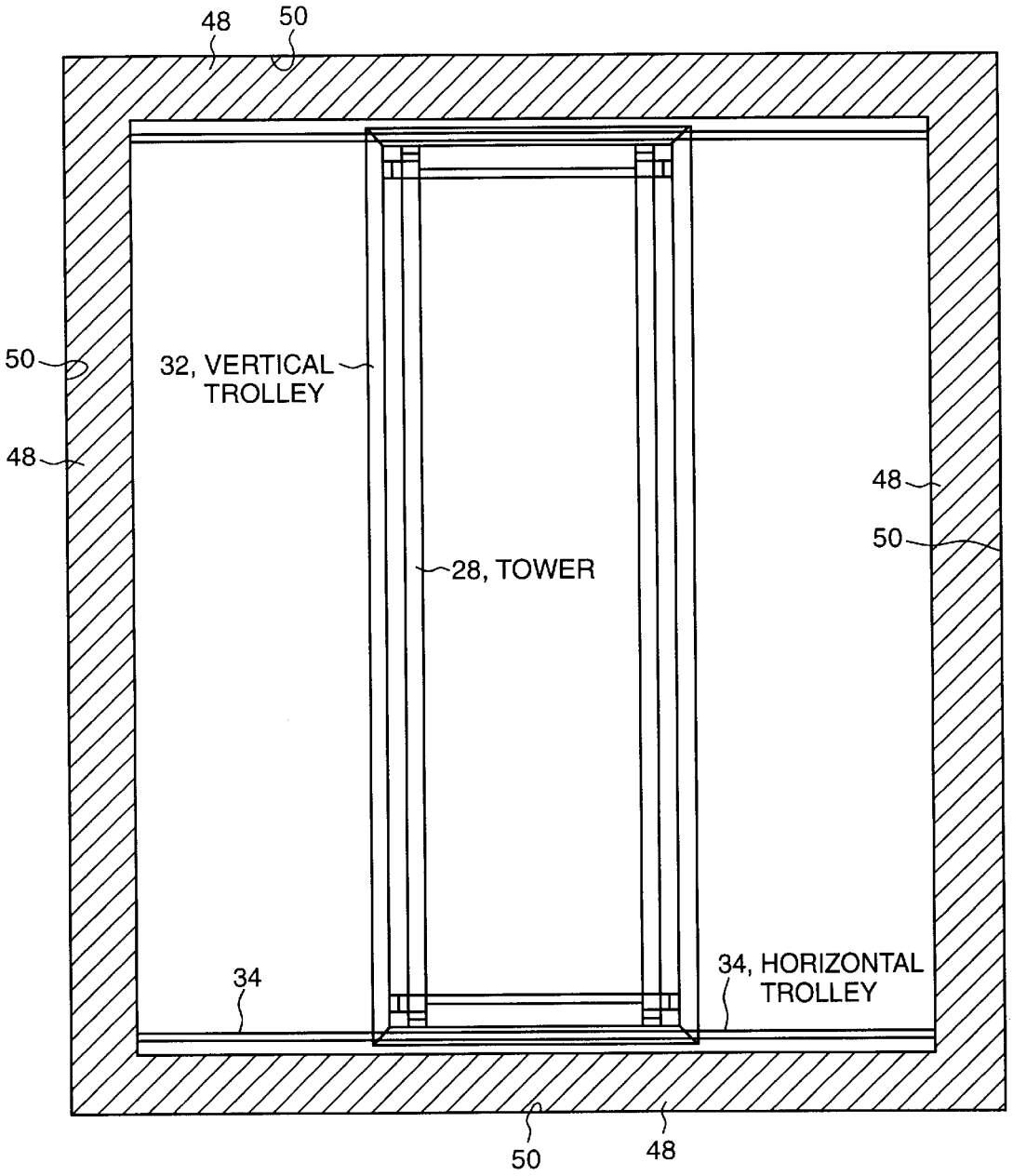
FIG. 3 is a schematic top plan view similar to FIG. 3, but showing the horizontal trolley centered.

The horizontal trolley 34 likewise is a rectangular framework fabricated of preferably high strength structural steel elements. It is supported on the vertical trolley 32 for bidirectional rolling or sliding movement in a horizontal plane between a neutral position (FIG. 3) and two opposite extreme positions (a representative one of which is shown in FIGS. 1 and 2), by a suitable extension-retraction system 44 (which may be a rack and gear; chain and sprocket; hydraulically or pneumatically operated extensible-retractable cylinders or the like, provided (like the vertical trolley) with suitable means for locking the trolley in any achieved position, despite bursting of a supply hose, or other failure of the system for changing the position of the trolley).

The horizontal trolley 34, as seen from above, preferably includes a walkway 48 made of open grating or expanded metal mesh for decking, which extends about all four sides of the outer perimeter of the horizontal trolley. The walkway 34 is rimmed by an upstanding safety rail 50.

The metal framing elements of the device 26 need not all be made of the same type of steel alloy. For instance, the horizontal trolley, because it is located closest to where the most-abrasive activity is occurring in use, may be made in whole or in part of high yield steel having greater resistance, in order to provide durability yet lightness in weight, while other parts are made of less expensive alloy.

In use, a hold 12 is emptied, and cleaned of loose and easily dislodged debris. It could be pre-cleaned using a high-pressure hose for washing, and the spent washwater pumped out.

A device 26 is lowered into the hold to become supported via the walking beams or powered trucks 30 on the deck 14 of the hold. If the crane operator and their spotter in the hold are particularly skillful, the initial placement of the device 26 may be in one of the four corners of the hold, corresponding to a first use position.

If the device 26 is lifted into the hold in sections made-up (i.e., assembled to one another) by stacking and locking, the various respective connectors of the sections of the electrical cables and supply/support pipes are connected to one another, and service is provided to the system 36 by respective lines connected thereto and extending up out of the hatch. Lighting provided at convenient locations on the tower 28 is lit, the human operators assume their positions and connect their breathing equipment, the hatch cover(s) is/are closed to the extent possible (given the ingress-egress of the electrical and fluid supply lines to and from the system 36). If needed, the walking beams 30 are operated to adjust the relative location of the device 26 into a first corner of the hold. Blast cleaning of the two side walls which meet at the respective corner of the hold begins. Before or after, the same or other operators, operating from services provided by the device 26, blast clean a quadrant of the deck 14 and, if desired, a quadrant of the underside of the hatch cover. In the course of this work, the operator(s) lower or raise the vertical trolley 34 (depending on whether the operator(s) is/are working from top, down, or from bottom, up, and extend/retract the horizontal trolley, in order to reach and perform nearly, or more or less than a quarter of the cleaning work. The operator or operators typically work on both of the two side walls which meet at the respective corner. When this cleaning has been completed, the device 26 is shifted using the horizontal position-shifting means (the walking beams 30) into each of the other three corners, whereupon, after each move, cleaning is conducted as explained above.

After spent abrasive is cleaned-up and air quality/temperature/humidity are adjusted, if needed, one or more of the same or different operators, again in four corner-related increments spray coat the surfaces 24 using trolley increments, and from locations on the walkways much the same as has been explained above in relation to cleaning. Upon completion, and determination that emissions of volatile organic chemicals have sufficiently declined due to air quality management, the hatch cover(s) is/are opened, the various cables and supply lines to and from the supply and support systems 36 to outside the hold are disconnected, and the device 26 is lifted out of the hold 10 (as a whole, or sequentially in, e.g., two sections, if modular), and lowered into another hold, ready for a next cleaning and coating operation on such other hold.

In the instances of especially long or wide holds, it may be necessary to shift the device as a whole to more than four sites (e.g., to six or eight sites, e.g., including one intermediate site on each of two or four sides), in order to perform all of the cleaning, and the same, again to conduct all of the coating.

It is possible that the device 26 can be used to perform some other tasks than blast cleaning or coating, such as high pressure washing or inspecting. It is also possible that only one task would be performed in regard to a particular hold on a particular occasion using the device 26, e.g., cleaning but not coating, or vice versa.

It is also possible to fit one or more horizontal extensions to the horizontal trolley in order to equip workers using the device 26 to use it for reaching especially far from the vertical tower 28.

In FIGS. 4 and 5, and FIGS. 6 and 7, the device 26 is shown provided respectively with a ventilation system, and with a modification to that ventilation system.

Figure 4:
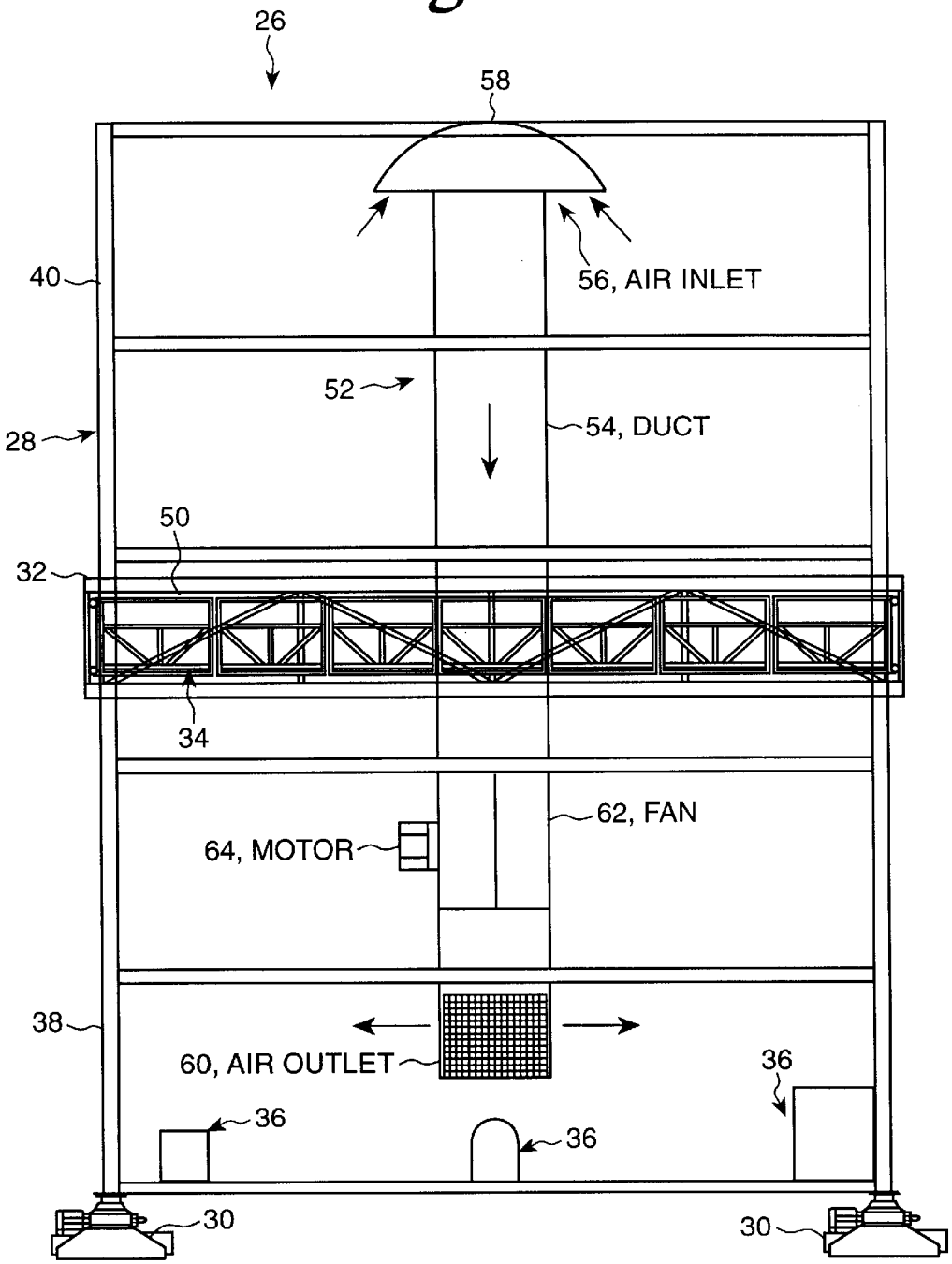
FIG. 4 is a side elevational view of the device, shown provided with a first embodiment of a ventilation system.
Figure 5:
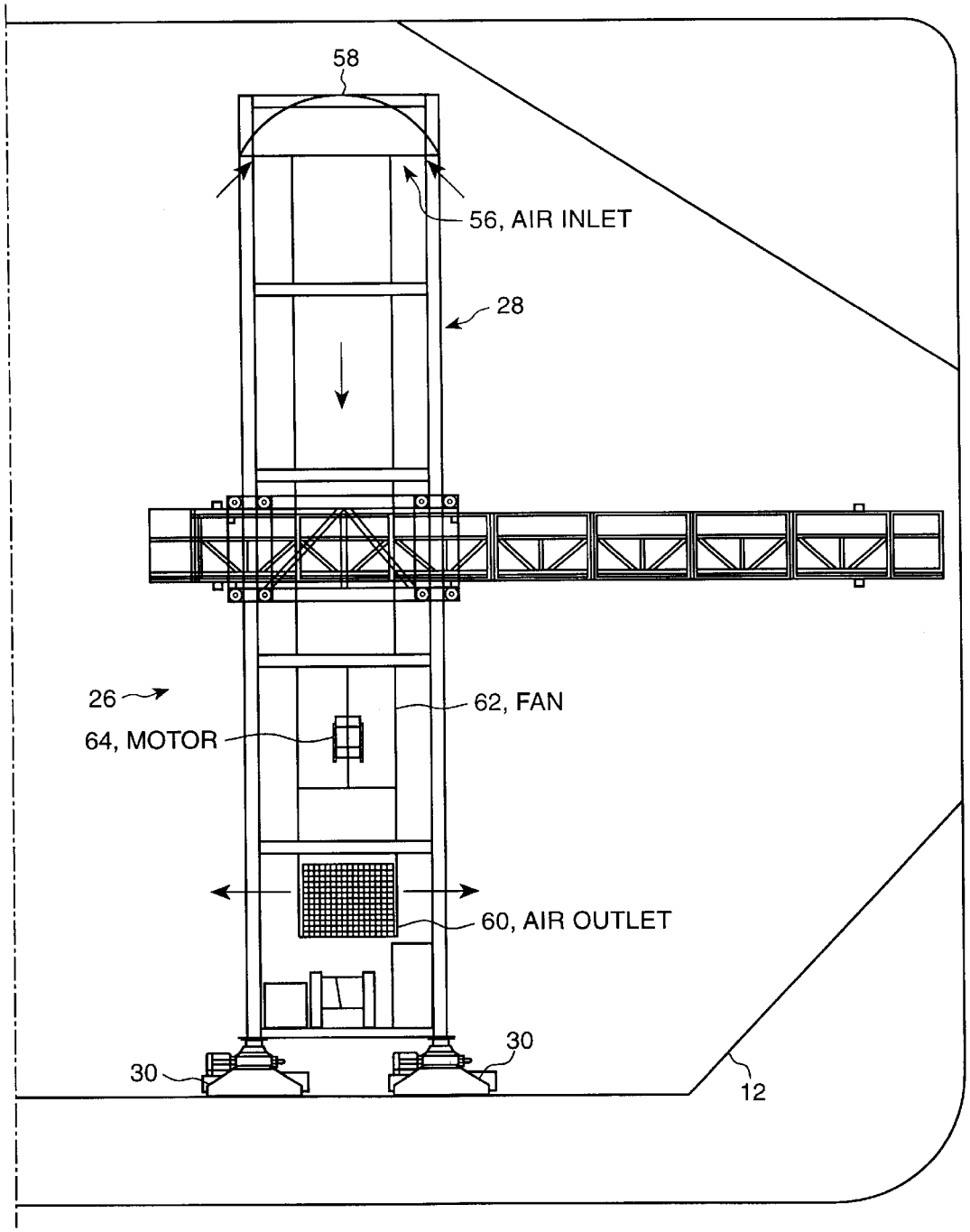
FIG. 5 is front elevational view thereof.
Figure 6:
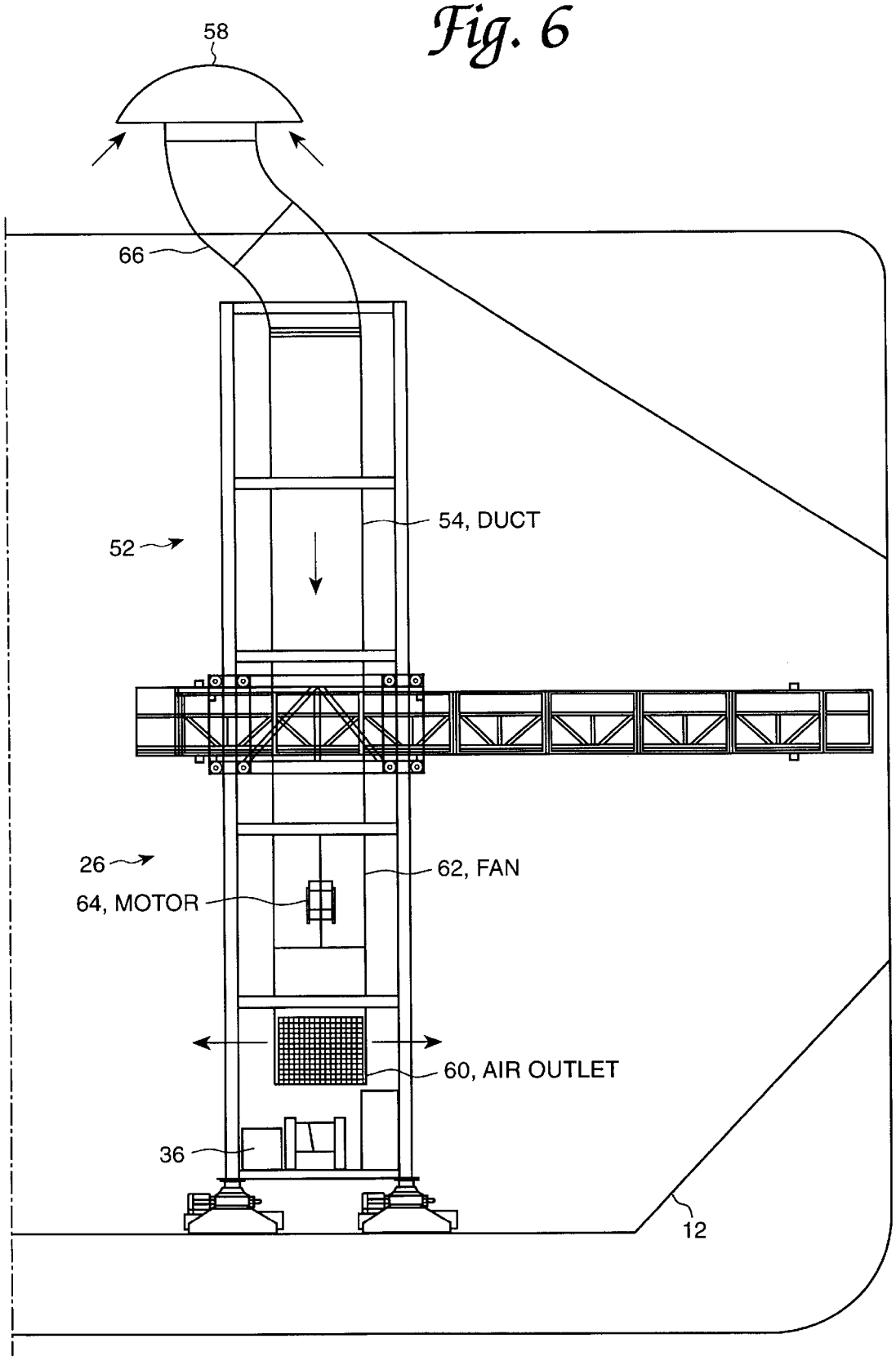
FIG. 6 is a front elevational view of a modification wherein the ventilation system is provided with a raised and swivelable inlet.

Referring first to FIGS. 4 and 5, the ventilation system 52, which is supported from the vertical tower 28, and powered and served by the supply and support systems 36, includes a vertical duct 54, provided at its upper end (which in this first instance) is located no higher up than the top of the tower 28, with an air inlet 56 shielded from above by a domed cap 58 which encloses a dust filter (not shown) for incoming air. The dust filter is removable for cleaning, removable for replacement if expendable or easier to clean elsewhere than in place, or cleanable in place.

The duct 54 is shown provided at its lower end with an air outlet 60, which also may be screen-covered for preventing large objects from entering or exiting from the air outlet. The air outlet 60 preferably is located near but above the base of the vertical tower 28, e.g., in order to be out of the way of the supply and support systems 36.

Between the air inlet 56 and outlet 60, there is a fan 62, operated by a motor 64, interposed in the duct 54, for causing ventilating air to be drawn into the duct 54, filtered at 58, and to blow out of the outlet at 60.

The motor 64 is served with power from the supply and support systems 36.

Figure 7:
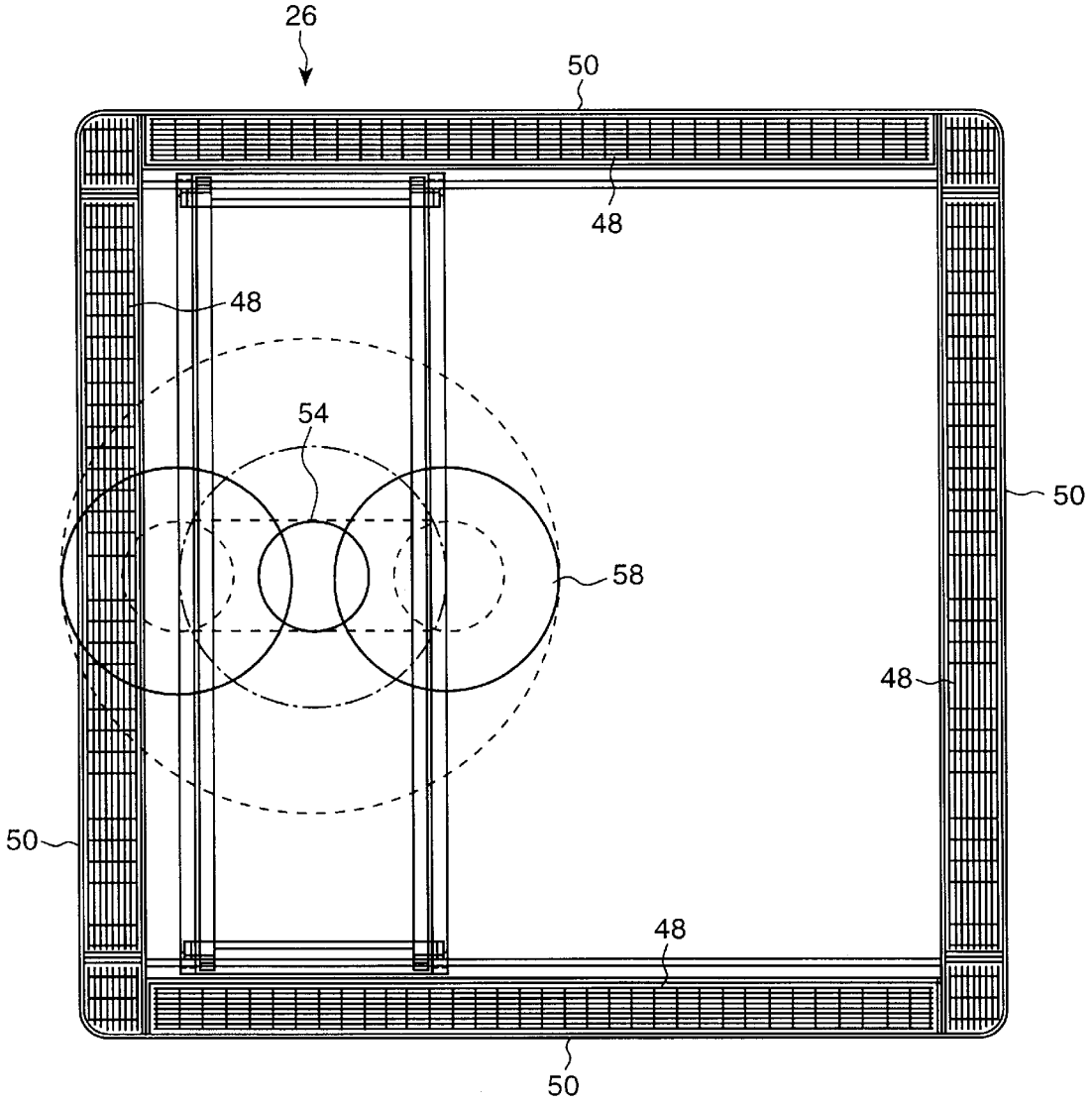
FIG. 7 is a top plan view of the ventilation system-provided device of FIG. 6.

Although the workers could depend on the ventilation system 52 to provide air from outside the hold (i.e., by partly opening the hatch cover), it is recommended that at least while abrasive blasting and spray coating are taking place, that workers in the hold wear ventilators, breathing masks or other air supply or filtration units. The ventilating system 52 aids in preventing such intensive airborne dust build-up that visibility is too low for the workers, for aiding in drying/curing of sprayed coatings, and for permitting temperature and humidity within the hold to be favorably influenced. In the variation shown in FIGS. 6 and 7, all is the same as that which has been shown in and described with reference to FIGS. 4 and 5, except that the domed cap 58 is mounted on a swivelable extension 66 of the duct 54. The extension 66 causes the inlet 56 to be located above the hatch of the hold 12, and the lateral offset provided by the swivelable extension allows the duct portion provided thereby and which extends up out of the hold, to avoid interference with restrictions to the hatch area. The envelope of possible movement and resulting placement of the swivelable extension are illustrated in FIG. 7.

It should now be apparent that the self-contained device for cleaning and coating hold surfaces in a bulk carrier as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

I claim:

1. A self-contained device for supporting one or more operators for applying work to internal wall surfaces of a bulk cargo vessel hold, comprising:

framework providing a vertical tower having a base;

a shiftable support structure supporting the tower base and arranged for shifting the tower about in each of two mutually orthogonal horizontal direction on a substantially horizontal deck of the hold. for stationing the tower in proximity with each of four corners where respective pairs of sidewalls of the hold meet one another;

a vertical trolley mounted to the vertical tower and vertically movable thereon to assume and maintain each of a plurality of selected vertical elevations:

a horizontal trolley mounted to the vertical trolley and bidirectionally horizontally movable thereon to assume and maintain each of a plurality of selected horizontal positions relative to the vertical tower, including a first extreme of extension in one direction to one side of the vertical tower and a second extreme of extension to an opposite side of the vertical tower;

a complement of supply systems for use in performing work on said surface. said systems being provided on said vertical tower:

an operator walkway provided on said horizontal trolley:

a ventilation duct supported by said vertical tower; said ventilation duct having an air inlet provided at an upper end thereof, and an air outlet provided at a lower end thereof;

a filter associated with said ventilation duct for filtering air drawn into the ventilation duct: and a fan interposed in said duct for causing air to be drawn into said duct through said inlet and expelled into the hold through said outlet;

said duct including a laterally offset upper end portion which extends above said vertical tower and being swivelable about a vertical axis, for locating said inlet at any of a plurality of laterally offset locations within a circular envelope of movement and disposition.

2. The self-contained device of claim 1, wherein:

said vertical tower is modular, including at least a lower module and an upper module, which are stackingly disconnectably connected, and said device comprises two sections, one of which includes said lower module, said base and said systems, and the other of which includes said upper module and said vertical and horizontal trolleys.

3. The self-contained device of claim 1, wherein:

said shiftable support structure is constituted by walking beams.

4. The self-contained device of claim 1, wherein said complement of supply systems includes:

apparatus for providing breathing air for said operator or operators.

5. The self-contained device of claim 1, wherein said complement of supply systems includes:

apparatus for supplying abrasive grit blasting equipment.

6. The self-contained device of claim 1, wherein said complement of supply systems includes:

apparatus for supplying coating spraying equipment.

7. The self-contained device of claim 1, wherein:

said horizontal trolley is generally rectangular in plan, and said operator walkway extends around all four sides of the outer perimeter of said horizontal trolley.

* * * * *